US006092642A

United States Patent [19]

Boldrini

[11] Patent Number: 6,092,642

[45] Date of Patent: Jul. 25, 2000

[54] METHOD OF FORMING GROUPS OF CIGARETTES

[75] Inventor: Fulvio Boldrini, Ferrara, Italy

[73] Assignee: G.D Societa' per Azioni, Bologna, Italy

[21] Appl. No.: 09/005,918

[22] Filed: Jan. 12, 1998

[30] Foreign Application Priority Data

Jan. 13, 1997 [IT] Italy ..... BO97A0013

[51] Int. Cl.[7] ..... B65G 47/30

[52] U.S. Cl. ..... 198/418.2; 198/450; 198/474.1

[58] Field of Search ..... 198/418.2, 450, 198/474.1, 476.1, 477.1, 449

[56] References Cited

U.S. PATENT DOCUMENTS 3,603,445 9/1971 Zausch ..... 198/418.3
4,364,464 12/1982 Manservisi et al. ..... 198/418.3
4,592,374 6/1986 Focke et al. ..... 198/418.3 X
4,614,263 9/1986 Nagata et al. .
5,769,205 6/1998 Belvederi et al. ..... 198/474.1 X
5,860,427 1/1999 Stivani et al. ..... 198/450 X

*Primary Examiner*—Christopher P. Ellis
*Assistant Examiner*—Gene O. Crawford
*Attorney, Agent, or Firm*—Marshall, O'Toole, Gerstein, Murray & Borun

[57] ABSTRACT

A method of forming groups of cigarettes, each group being defined by at least one layer of cigarettes arranged side by side. The layer is fed continuously at a given speed and by means of a conveying seat along a given annular path extending through an unloading station. At the unloading station where the layer is transferred from the seat to a group forming pocket (6) by orienting the seat with respect to the path as a function of the relative position of the seat and the pocket (6) at least at the unloading station.

14 Claims, 5 Drawing Sheets

9
39
32c
34
32a
38
32b
3
39
39
7
47
49
46
48
1
10
45
36
35
37
35
35
13
36
37
33
44
41
40
42
43
P2
56
11
52
51
50
64
63
53
55
54
61
60p
60
12
59
60u
58
57
60u
12
8a
21
28
22
D
6
P1
17
62
59
60p
5
61
14
4a
3
15

METHOD OF FORMING GROUPS OF CIGARETTES

BACKGROUND OF THE INVENTION

The present invention relates to a method of forming groups of cigarettes.

Groups of cigarettes, each normally comprising three superimposed layers of cigarettes arranged in a five-spot pattern, are known to be formed by feeding a forming pocket in a given direction along a forming path extending through three unloading stations, at each of which the pocket is supplied with a respective layer by a respective transfer device located between the path and a cigarette hopper.

Each pocket is normally defined by a bottom wall, and by a front and rear wall crosswise to the bottom wall and comprising respective longitudinal projections for engaging respective cavities defined by the outermost cigarettes in the intermediate layer and the adjacent outermost cigarettes in the top and bottom layers, to retain the cigarettes in position inside the pocket. The transfer device at each unloading station normally comprises a lobed drum rotating about a respective horizontal axis crosswise to the traveling direction of the forming pocket, and comprising a number of lobes, the free end of each of which comprises a respective transfer seat for transferring a respective layer of cigarettes; and each seat is fed through the respective unloading station in time with a forming pocket, and engages the pocket to deposit the respective layer.

The above method involves several drawbacks. Firstly, the longitudinal projections in the forming pocket allow only partial insertion of each lobe to deposit the respective layer, so that the cigarettes are dropped from the lobe into the pocket. Secondly, being spaced relatively far apart in the transfer seat, the cigarettes must be compacted inside the forming pocket by compacting devices along the forming path to obtain groups of cigarettes suitable for wrapping.

SUMMARY OF THE INVENTION

It is an object of the present invention to provide a straightforward, low-cost method of forming groups of cigarettes, designed to overcome the aforementioned drawbacks.

According to the present invention, there is provided a method of forming groups of cigarettes, each group comprising at least one layer of cigarettes arranged side by side, and the method comprising the step of continuously feeding said layer at a given speed and by means of a conveying seat along a given annular first path extending through a supply station where the layer is fed into the conveying seat, and through an unloading station, the first path being substantially tangent to a second path at the unloading station; the further step of continuously feeding a forming pocket along the second path and through said unloading station in time with said conveying seat; and a transfer step whereby said layer is transferred from the conveying seat to the forming pocket at said unloading station; the method being characterized by also comprising an orienting step whereby said conveying seat is oriented with respect to said first path as a function of the relative position of the conveying seat and the forming pocket at least at said unloading station.

BRIEF DESCRIPTION OF THE DRAWINGS

Two non-limiting embodiments of the present invention will be described by way of example with reference to the accompanying drawings, in which.

DETAILED DESCRIPTION OF THE INVENTION

Figure 1:
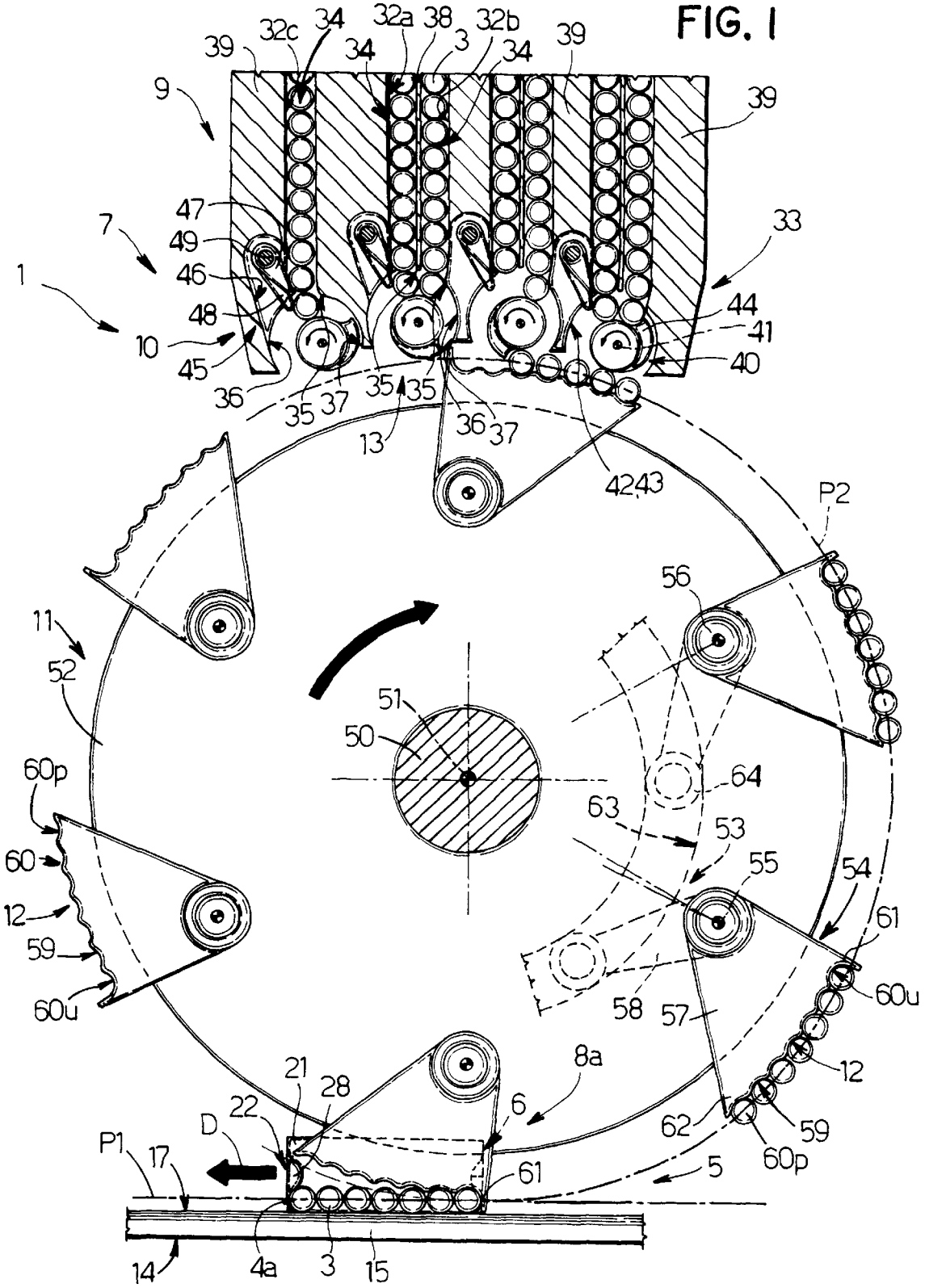
FIG. 1 shows a side view, with parts in section and parts removed for clarity, of a preferred embodiment of a unit implementing the method according to the present invention.
Figure 3:
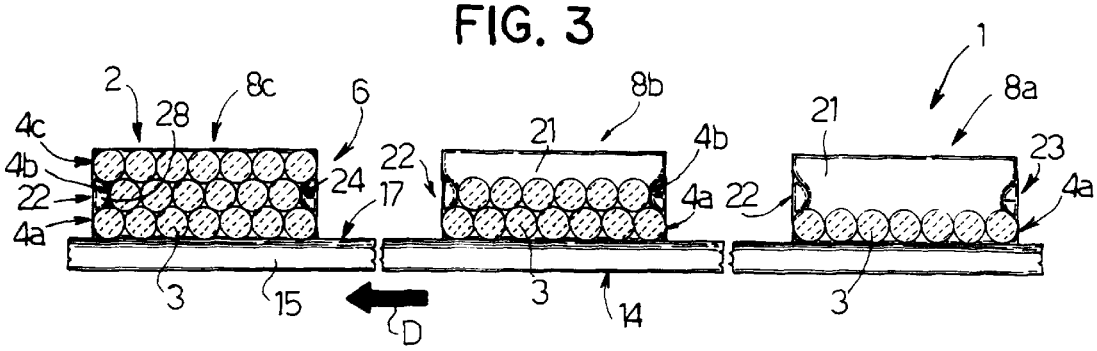
FIG. 3 shows a side view, with parts in section and parts removed for clarity, of the FIG. 2 detail in three different operating positions.
Figure 4:
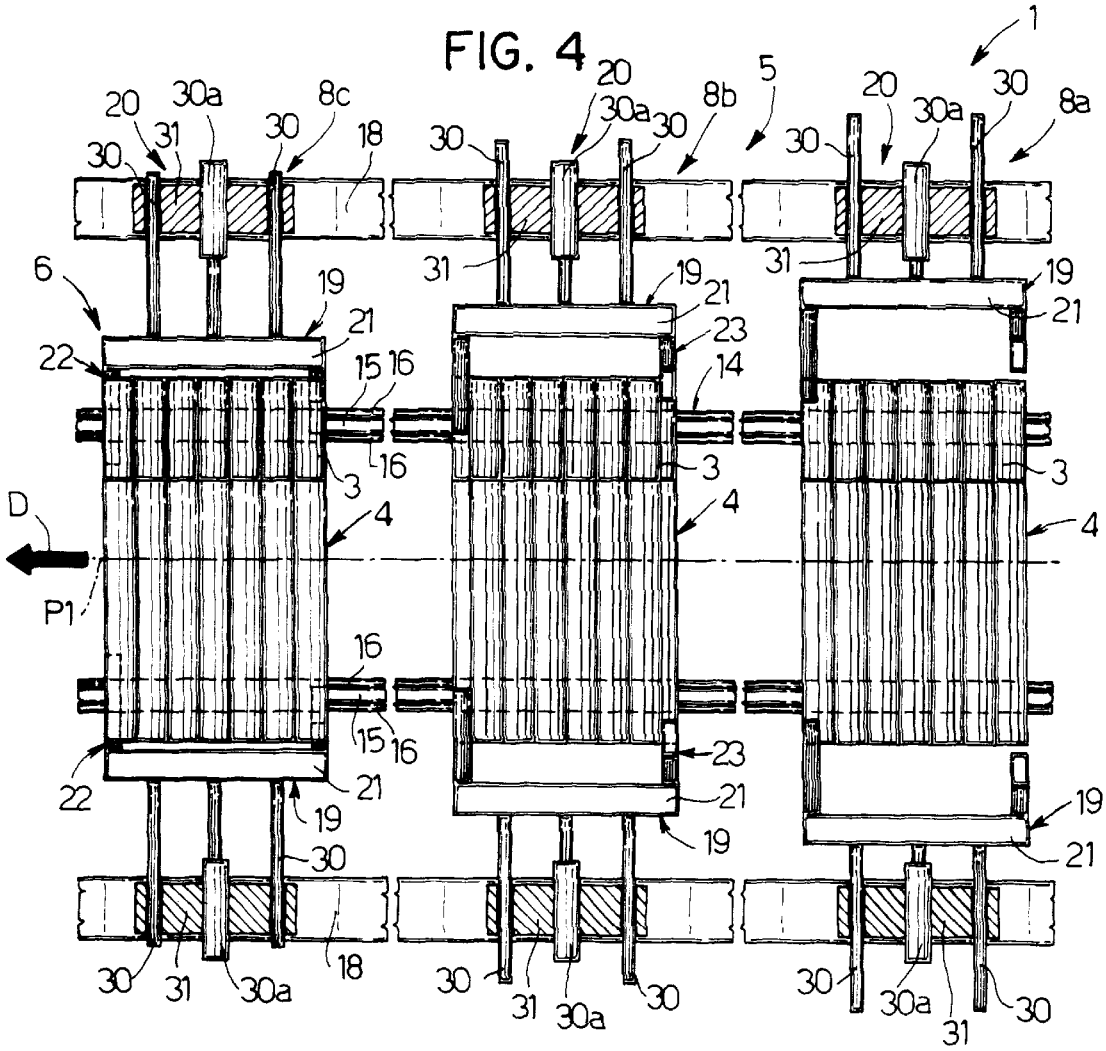
FIG. 4 shows a plan view, with parts in section and parts removed for clarity, of the FIG. 2 detail in three different operating positions.

Number 1 in FIGS. 1, 3 and 4 indicates a unit for forming groups 2 of cigarettes 3 arranged in a five-spot pattern, and wherein each group 2 is defined by three superimposed layers 4 of cigarettes 3. More specifically, the layer indicated 4*b* is an intermediate layer interposed between and having one cigarette 3 fewer than the outer layers indicated 4*a* and 4*c*.

Unit 1 comprises a pocket conveyor 5 traveling continuously in a given direction D along a given path P1, and in turn comprising a succession of pockets 6, each for housing a respective group 2; and a supply device 7 located over conveyor 5 and for feeding each layer 4 to conveyor 5 at a respective supply station 8. More specifically, device 7 supplies the three layers 4*a*, 4*b*, 4*c* at respective stations 8*a*, 8*b*, 8*c* located in series along path P1, so as to form a group 2 inside respective pocket 6 by inserting a layer 4*a* inside pocket 6 at station 8*a*, subsequently inserting a layer 4*b* on top of layer 4*a* at station 8*b*, and finally inserting a layer 4*c* on top of layers 4*a* and 4*b* at station 8*c*.

For each station 8, supply device 7 comprises an outlet 9 of a hopper (not shown) containing cigarettes 3, which are fed by the outlet to a respective bottom end 10; and a transfer device 11, in turn comprising a number of seats 12, which are movable substantially along a transfer path P2 tangent to path P1 at station 8 and to respective end 10 at a loading station 13, and which receive cigarettes 3 from respective outlet 9 to form and transfer a respective layer 4 to respective station 8. FIG. 1 shows only one station 8, namely station 8*a*, the respective outlet 9 and respective transfer device 11, and anything said in the following description concerning station 8*a* also applies, unless otherwise stated, to stations 8*b* and 8*c*.

Conveyor 5 comprises a horizontal guide 14 extending along path P1 to support groups 2 during formation, and defined by two parallel rails 15, which are separated by a distance smaller than the length of cigarettes 3, and comprise, on the top facing outlets 9, respective pairs of shaped projections 16 defining a flat horizontal surface 17 for supporting groups 2 and in turn defining the bottom surface of pockets 6. Conveyor 5 also comprises two conveyor belts 18, which are located on either side of guide 14, are separated by a distance greater than the length of cigarettes 3, provide for feeding pockets 6 in direction D at a given speed V1, and are looped about two pulleys (not shown) located along path P1 up- and downstream from the hopper in direction D.

Figure 2:
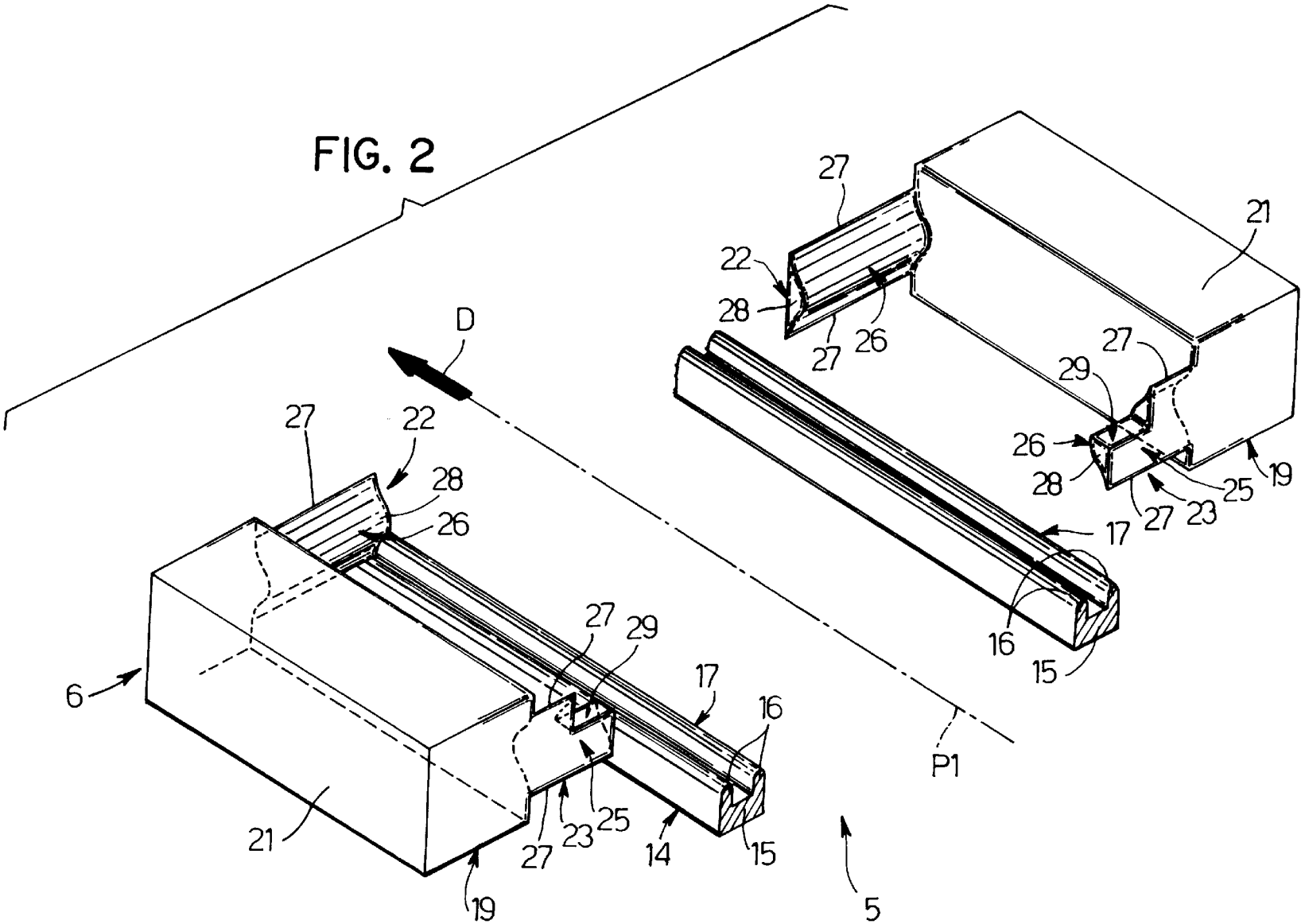
FIG. 2 shows a larger-scale view in perspective, with parts in section and parts removed for clarity, of a detail in FIG. 1.

As shown in FIG. 2, each pocket 6 comprises two opposite retaining heads 19, which are fitted to respective belts 18, are movable by an actuating device 20, and each comprise a vertical wall 21 parallel to direction D, and axial appendixes 22 and 23 extending transversely from wall 21 towards the appendixes 22, 23 of the other wall 21. Heads 19 are movable in steps between an open position wherein walls 21 are separated by a given distance greater than the length of cigarettes 3 and appendixes 22, 23 are located outwards of respective group 2, and a retaining position wherein walls 21 substantially contact the ends of cigarettes 3 of respective group 2 inside pocket 6, and appendixes 22, 23 are substantially housed inside respective lateral cavities 24 defined by the outermost cigarettes 3 in layer 4*b* with the outermost cigarettes 3 in layers 4*a* and 4*c*, and retain cigarettes 3 of group 2 in a direction crosswise to cigarettes 3 and parallel to supporting surface 17.

More specifically, each appendix 22, 23 comprises a flat surface 25 facing outwards of pocket 6; and a shaped surface 26 facing inwards of pocket 6 and defining, with surface 25, two tapered longitudinal edges 27, which are positioned flush with the respective outermost cigarettes 3 of layers 4*a* and 4*c* to retain cigarettes 3 in said crosswise direction. Outer surface 25 is a flat vertical surface, whereas inner surface 26 defines a substantially cylindrical longitudinal projection 28 of substantially the same radius of curvature as the cigarettes, and which fits inside respective cavity 24 to retain the respective outermost cigarette 3 in layer 4*b* as layers 4*a* and 4*b* and respective group 2 are conveyed, in use, by pocket 6.

Appendix 22 of each head 19 is located in front of appendix 23 in the traveling direction of pocket 6, and is of a given length Ll greater than the length L2 of appendix 23, which in turn comprises a flat surface 29 formed at one end of respective top edge 27. Flat surfaces 29 extend inwards of respective appendixes 23 by a length L3 substantially equal to half of length L2 and to a third of length L1, and permit insertion of layer 4*b* inside respective pocket 6.

For each head 19, actuating device 20 comprises two rods 30 connected to wall 21 of head 19 and fitted in sliding manner through a respective support 31 integral with respective belt 18; and a linear actuator 30*a* fitted to support 31 and connected to wall 21 to move head 19 towards the other head 19 at each station 8 and so gradually retain layers 4 inside pocket 6.

As shown in FIG. 1, each outlet 9 comprises a given N1 number of channels 32 equal to the number of cigarettes 3 to be fed to a seat 12 at respective station 13, i.e. equal to N2 number of cigarettes 3 in the respective layer 4 to be supplied at station 8; and a regulating device 33 located at bottom end 10 of outlet 9, and for regulating the supply of cigarettes 3 from channels 32.

Channels 32 are vertical and parallel, and provide for gravity feeding respective columns 34 of cigarettes 3 to respective output openings 35 substantially arranged along an arc A parallel to path P2 at end 10 of outlet 9. In the case of outlets 9 at stations 8*a* and 8*c*, N1-1 number of channels 32 (indicated 32*a*, 32*b*) are arranged in pairs with the openings 35 of each pair facing a respective common substantially cylindrical inflow seat 36 having a respective bottom output opening 37 for cigarettes 3; and one channel 32 (indicated 32*c*) is substantially isolated from the other channels 32, but has respective opening 35 facing a respective seat 36. Output 9 at station 8*b*, on the other hand, has no channel 32*c*, and channels 32 are all arranged in pairs to feed respective cigarettes 3 in pairs to respective inflow seats 36.

Channels 32*a* and 32*b* in each pair are separated by a respective relatively thin vertical partition 38 terminating at the two openings 35; channel 32*c* and pairs of channels 32*a*, 32*b* are separated by respective vertical partitions 39 thicker than partitions 38; and the two outermost partitions 39 at opposite ends of arc A define respective lateral walls of outlet 9.

For each seat 36, regulating device 33 comprises an extracting element 40, which is mounted for rotation inside seat 36, is rotated about a respective horizontal axis 41 crosswise to direction D by a control device (not shown) , and defines, with an inner surface 42 of seat 36, a curved withdrawal channel 43 extending along output openings 35 of the respective pair of channels 32*a*, 32*b* and interrupted by respective bottom opening 37.

More specifically, each element 40 is so located as to interfere with both channels 32*a*, 32*b* terminating at respective seat 36, and comprises an extracting tooth 44 imparting to element 40 substantially the shape of a comma, and which moves along channel 43 to simultaneously extract two cigarettes 3 from channels 32*a*, 32*b* and one cigarette 3 from channel 32*c*, and feed cigarettes 3 to a seat 12 traveling through station 13.

For at least one channel in each pair of side by side channels 32*a*, 32*b* and for each channel 32*c*, regulating device 33 comprises a retaining device 45 controlled by said control device, and which provides for preventing the passage of cigarettes 3 through opening 35 of the relative channel 32, and for preventing cigarettes 3 from being fed along withdrawal channel 43 until they are engaged, in use, by tooth 44.

More specifically, each retaining device 45 is housed inside a respective seat 46 formed, in the example embodiment shown, to the side of channel 32*a* and in respective partition 39, and comprises two retaining levers 47 and 48, which are fitted to a respective shaft 49 parallel to axis 41, and are connected independently to said control device by a known transmission. In the example embodiment shown, levers 47 and 48 comprise respective twin levers (not shown) fitted to the opposite end of respective shaft 49, so that each cigarette 3 is engaged at at least two opposite end points.

Levers 47 are shorter than levers 48, and are movable between a retaining position interfering with cigarettes 3 in respective channel 32 and retaining cigarettes 3 substantially at respective opening 35, and a rest position housed entirely inside respective seat 46; and levers 48 are movable between a retaining position interfering with a cigarette 3 resting on extracting element 40 inside channel 43 to prevent cigarette 3 from being fed along channel 43, and a rest position housed entirely inside respective seat 46.

Figure 5A:
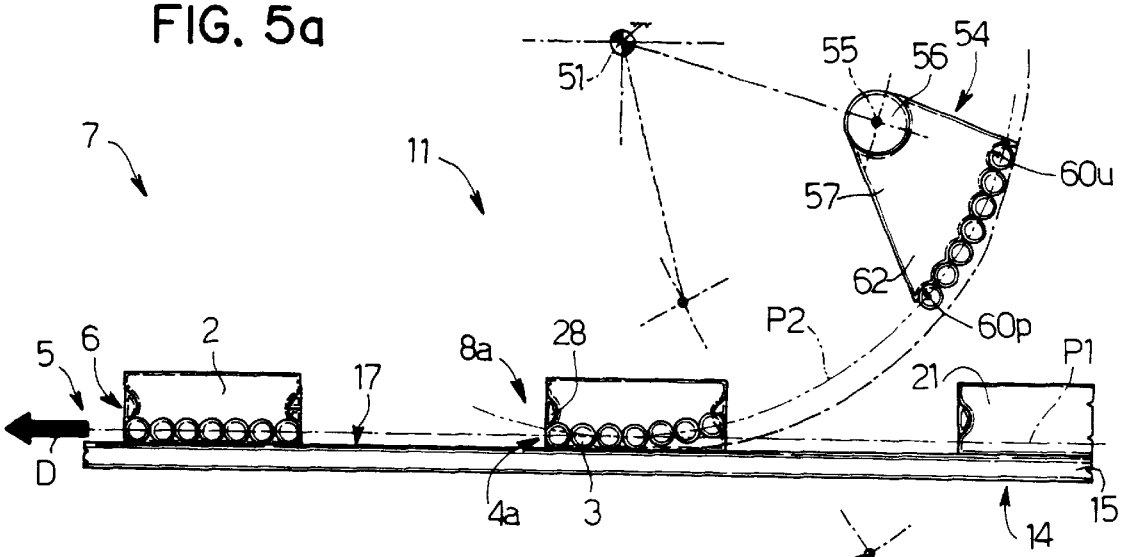
FIGS. 5 and 6 show schematic views, with parts in section and parts removed for clarity, of a series of operating positions of the FIG. 1 unit.
Figure 5B:
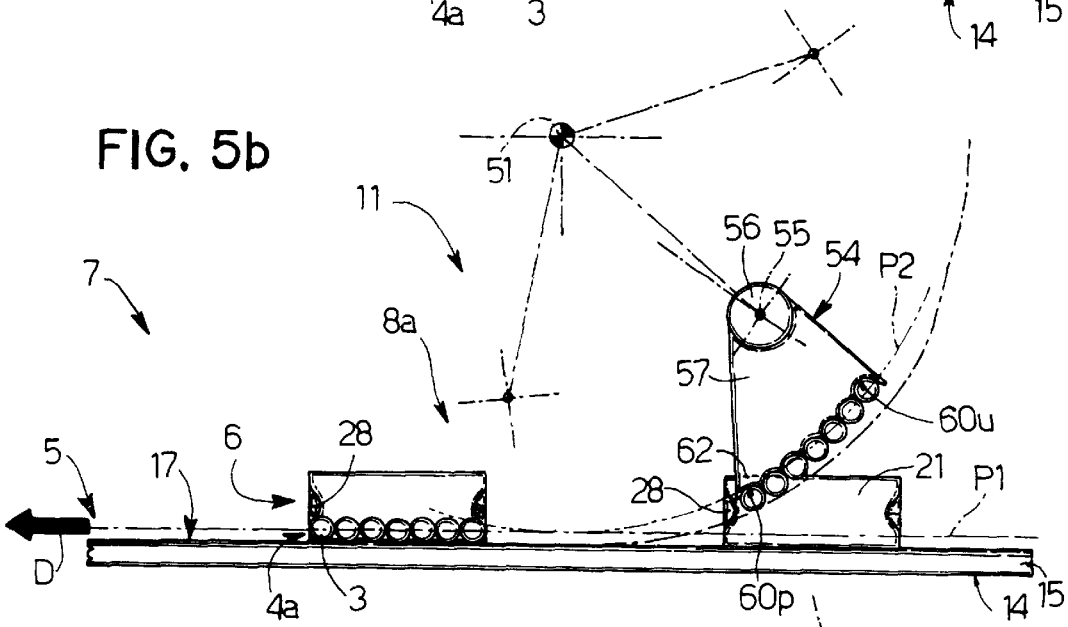
Figure 5C:
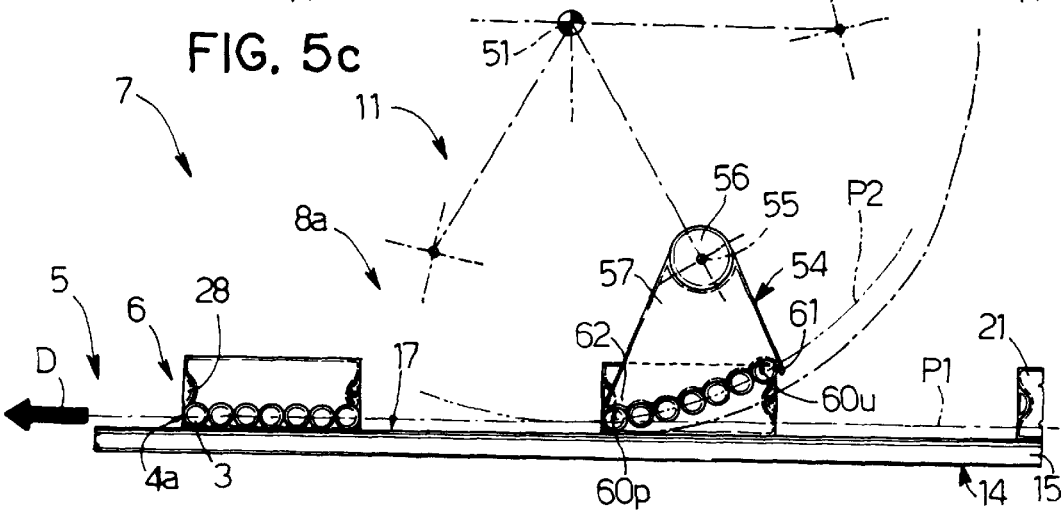
Figure 6A:
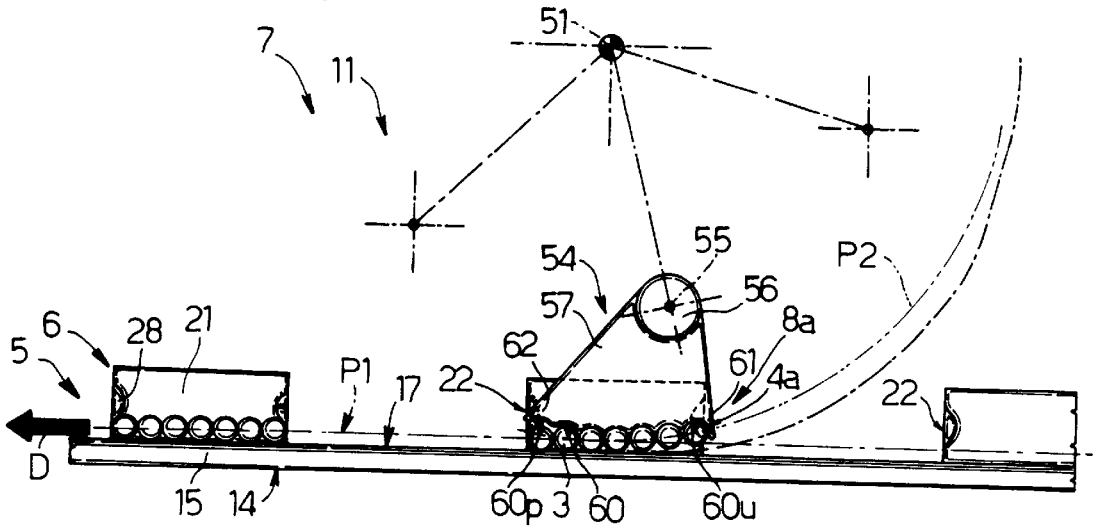
Figure 6B:
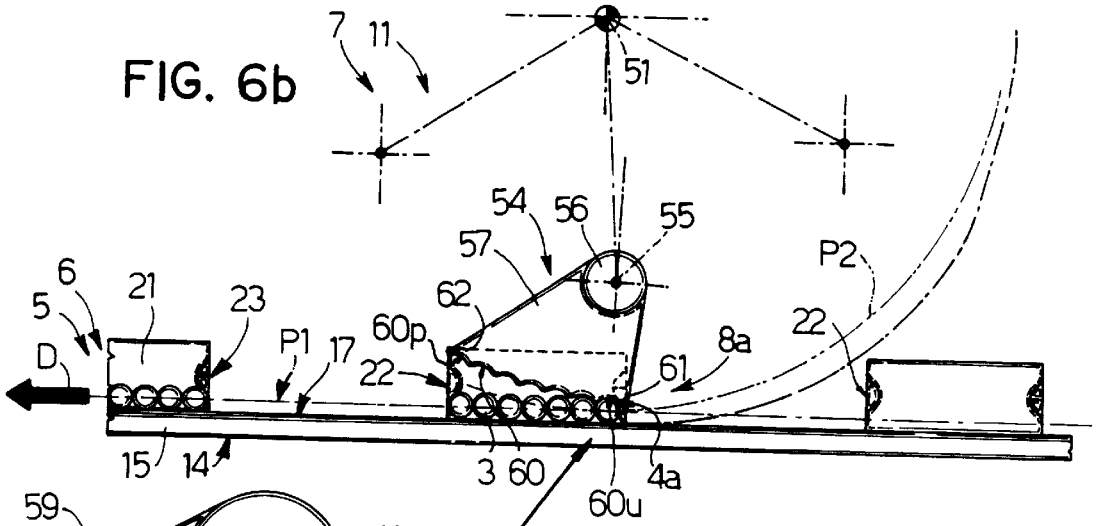
Figure 6B:
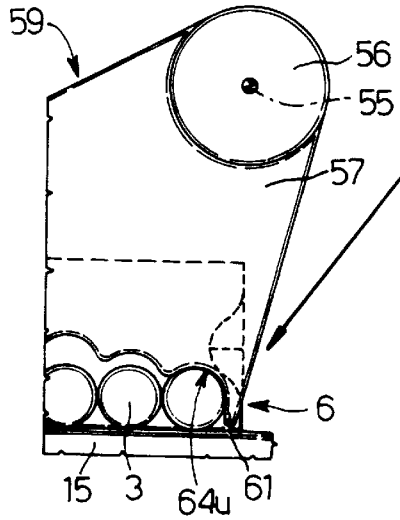

As shown in FIGS. 1, 5 and 6, transfer device 11 comprises a drive shaft 50 rotating continuously clockwise (in FIGS. 1, 5 and 6) about an axis 51 of rotation parallel to axes 41 and crosswise to direction D; a disk 52 fitted to shaft 50; and an orienting device 53, in turn comprising, for each seat 12, a respective orienting unit 54 fitted in rotary manner to disk 52 so as to oscillate about a respective axis 55 of orientation parallel to axis 51. More specifically, disk 52 is so rotated about axis 51 that, if each unit 54 were to maintain respective seat 12 in a fixed position along path P2, seat 12 and consequently cigarettes 3 in respective layer 4 would travel, at station 8, at a tangential speed V2 equal to the traveling speed V1 of pockets 6.

Each unit 54 comprises a respective supporting shaft 56 fitted in rotary manner through disk 52 and coaxial with respective axis 55; a substantially triangular plate 57 fitted to one end of shaft 56 and of a thickness smaller than the length of cigarettes 3; and an arm 58 fitted angularly integral with the opposite end of shaft 56 on the opposite side of disk 52 to plate 57. Along a peripheral surface 59 facing outwards of disk 52, plate 57 comprises a given number of grooves 60 defining respective seat 12, and which are arranged parallel to axis 51 to receive respective cigarettes 3. Grooves 60 are equal in number to the cigarettes 3 in respective layer 4, and comprise a number of holes (not shown) connected in known manner to a pneumatic suction device to retain cigarettes 3 by suction inside respective seat 12.

Surface 59 in which grooves 60 are formed extends along a cylindrical portion with a radius of curvature substantially equal to the radius of disk 52; and the last groove 60 (indicated 60*u*) along seat 12 in the rotation direction of disk 52 comprises a longitudinal wall 61, which extends radially outwards from surface 59 by a length approximately equal to but no greater than the thickness of cigarette 3, and comprises a central cavity (not shown) engaged, as described in detail later on, by teeth 44 of regulating device 33.

More specifically, wall 61 extends up to a virtual plane tangent with cigarettes 3 inside respective grooves 60, and provides, as described in detail later on, for compacting cigarettes 3 inside respective pocket 6 as cigarettes 3 are released from seat 12 into pocket 6.

The first groove 60 (indicated 60*p*) along seat 12 in the rotation direction of disk 52 is separated from axis 55 by a distance greater than that between axis 55 and groove 60*u*, so that plate 57 is in the form of a scalene triangle, one side of which is defined by surface 59, the shortest side of which extends from axis 55 to groove 60*u*, and the longest side of which extends from axis 55 to groove 60*p*, and defines, with groove 60*p*, a wedge-shaped front appendix 62 of plate 57.

Orienting device 53 comprises an annular cam 63 extending about axis 51 and formed in the face of a fixed disk (not shown) facing and coaxial with disk 52; and, for each unit 54, a respective tappet roller 64 fitted in rotary manner to a free end of respective arm 58. Cam 63 is so formed that, as disk 52 rotates, device 53 varies the orientation of each unit 54 between: a transfer position in which surface 59 is parallel to path P2, and appendix 62 of unit 54 is aligned with path P2; a first offset position in which surface 59 is inclined with respect to path P2, and appendix 62 projects radially outwards from path P2; and a second offset position in which surface 59 is inclined with respect to path P2, but the opposite way to the first offset position, and appendix 62 projects radially inwards from path P2.

Operation of unit 1 will now be described as of the instant in which cigarettes 3 of a layer 4*a* are extracted from respective outlet 9 and deposited by extracting elements 40 inside a seat 12 traveling through loading station 13 along path P2; and a pocket 6, with respective heads 19 in the open position, is fed by conveyor 5 towards station 8*a* to reach station 8*a* in time with the corresponding seat 12.

The cigarettes 3 in each pair of channels 32*a*, 32*b* and channel 32*c* are fed onto respective extracting elements 40 as these rotate about axes 41 to feed teeth 44 along channels 43. More specifically, whereas the fall of cigarettes 3 from channels 32*b* is regulated solely by respective elements 40, the fall of cigarettes 3 from channels 32*a* and 32*c* is regulated first by respective levers 47 and then by respective elements 40, and, once the latter cigarettes 3 reach respective channels 43, they are retained by levers 48 to prevent them from falling out of channels 43 through respective bottom openings 37. Upon teeth 44 contacting cigarettes 3, levers 48 are withdrawn into the rest position, and teeth 44 feed cigarettes 3 into seat 12 traveling through station 13. As unit 54 travels beneath openings 37, cigarettes 3 are fed into seat 12 by elements 40 to form a layer 4*a* in seat 12, and the recess in wall 61 is engaged by teeth 44 of elements 40 as teeth 44 rotate outside respective channels 43.

To enable seat 12 to receive cigarettes 3 at station 13, device 53 so orients unit 54 that surface 59 is parallel to arc A and to path P2, i.e. sets unit 54 to the transfer position; and seat 12 is subsequently oriented with respect to pocket 6 to feed layer 4*a* into pocket 6. That is, as unit 54 approaches station 8*a* and pocket 6, device 53 moves unit 54 into the first offset position, i.e. rotates unit 54 anticlockwise about axis 55 so as to move seat 12 in the opposite direction to the rotation direction of disc 52 and temporarily slow down cigarettes 3, i.e. delay layer 4*a* with respect to rotation of disk 52, and so as to position first groove 60*p* and respective cigarette 3 radially outwards of path P2 (FIGS. 5*a* and 5*b*). This position enables unit 54 to be gradually inserted inside pocket 6 without cigarette 3 in groove 60*p* or front appendix 62 colliding with appendixes 22 of pocket 6.

As unit 54 and respective pocket 6 travel simultaneously through station 8*a*, unit 54 is gradually wedged inside pocket 6 until cigarette 3 in first groove 60*p* is substantially positioned facing the underside of longitudinal projection 28; at which point, device 53 rotates unit 54 clockwise to successively set unit 54 back into the transfer position, synchronize seat 12 once more with pocket 6, and insert cigarette 3 of first channel 60*p* onto the underside of projection 28 (FIG. 5*c*). Once cigarette 3 of first channel 60*p* is positioned contacting surfaces 26 and 17, rotation of disk 52 about axis 51 and the simultaneous forward travel of pocket 6 enable cigarettes 3 to be deposited one after the other inside pocket 6 (FIG. 6*a*) and onto surface 17, with respect to which, surface 59 performs a straightforward rolling movement. A known distributing device (not shown) gradually cuts off suction through the holes in grooves 60 to permit release of cigarettes 3.

As cigarette 3 in the last groove 60*u* contacts surface 17 (FIG. 6*b*), device 53 rotates unit 54 even further clockwise into the second offset position, so that wall 61 travels faster than pocket 6, seat 12 is advanced with respect to pocket 6, and wall 61 and cigarette 3, substantially still housed inside groove 60*u*, provide for compacting cigarettes 3 in layer 4*a* inside pocket 6. Inside seat 12, in fact, cigarettes 3 are not positioned contacting each other, and must therefore be compacted inside pocket 6, not only to enable pocket 6 to be gradually closed about group 2 being formed, but also to permit subsequent wrapping of group 2 in known manner.

Before pocket 6 is disengaged by unit 54 and fed to station 8*b*, actuating devices 20 move heads 19 one step towards each other, so that rear appendixes 23 are separated by a distance smaller than the length of cigarette 3, and layer 4*a* is retained both at the front and rear. Once pocket 6 is disengaged by wall 61, cigarettes 3 in layer 4*a* are therefore firmly retained inside pocket 6, which is then fed to stations 8*b* and 8*c*, where it is supplied with layers 4*b* and 4*c* in substantially the same way as described for layer 4*a*. As the rolling surface of cigarettes 3 in the subsequent layers, however, is defined by the top surface of the previously deposited layer 4, the axes 51 of disks 52 of transfer devices 11 supplying layers 4 to stations 8*b* and 8*c* are offset vertically with respect to each other and to axis 51 of disk 52 of station 8*a*.

Figure 7:
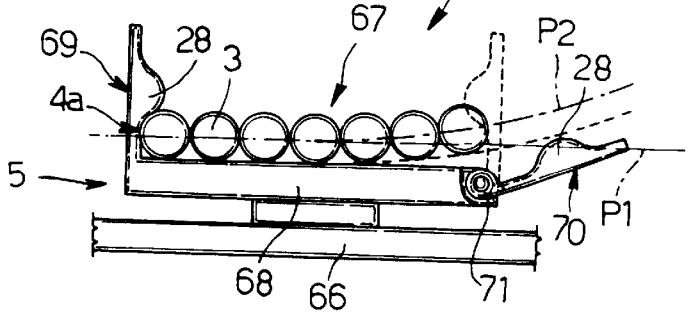
FIG. 7 shows, with parts in section and parts removed for clarity, an alternative embodiment of the FIG. 3 detail.

FIG. 7 shows a pocket conveyor 65 similar to conveyor 5, but comprising an endless belt 66 in place of guides 14, and a number of pockets 67 for forming groups 2. Each pocket 67 comprises a bottom wall 68 connected integrally to belt 66; a front wall 69 in place of appendixes 22, but again comprising a longitudinal projection 28; and a rear wall 70 in place of appendixes 23 of pocket 6, but which again comprises a projection 28, and is hinged along a bottom edge 71 to wall 68 so as to rotate between a lowered loading position in which wall 70 is substantially coplanar with wall 68, and a raised retaining position in which wall 70 is parallel to wall 69 and crosswise to wall 68 to retain layer 4 inside pocket 67.

Unit 1 operates in the same way with conveyor 65 as with conveyor 5, except that, as layer 4*a* is unloaded by unit 54 inside pocket 65 at station 8*a*, wall 70 is immediately raised into the retaining position, and pocket 65 remains unchanged until group 2 is completed.

What is claimed is:

1. A method of forming groups of cigarettes, each group comprising at least one layer of cigarettes arranged side by side, wherein the method comprises a step of continuously feeding said layer at a given speed and by means of a transfer device comprising a carrier and a conveying seat movable on the carrier for transporting the conveying seat along a given annular first path (P2) extending through a supply station where the layer is fed into the conveying seat, and through an unloading station, the first path (P2) being substantially tangent to a second path (P1) at the unloading station, with the conveying seat being oriented from an initial position on the carrier to a second position at least at the unloading station; a step of continuously feeding a forming pocket along the second path (P1) and through said unloading station in time with said conveying seat; a transfer step whereby said layer is transferred from the conveying seat to the forming pocket at said unloading station; and an orienting step whereby said conveying seat is oriented with respect to said carrier as a function of the relative position of the conveying seat and the forming pocket at least at said unloading station.

2. A method as claimed in claim 1, wherein the further step of gravity feeding the cigarettes of a said layer to said supply station by means of a given number of supply channels; each supply channel supplying a respective column of cigarettes, and comprising a respective output opening for the cigarettes in said column.

3. A method as claimed in claim 2, wherein said supply channels are vertical supply channels and are arranged parallel to one another.

4. A method as claimed in claim 3, wherein at least two of said supply channels are arranged side by side, with the respective said output openings facing a common inflow seat for the cigarettes in the respective said columns.

5. A method as claimed in claim 4, including the further step of extracting said cigarettes from said inflow seat by means of extracting means housed inside the inflow seat.

6. A method as claimed in claim 5, wherein said extracting means simultaneously extract from the respective inflow seat at least two adjacent cigarettes of a said layer.

7. A method as claimed in claim 1, wherein said transfer step comprises the further step of inserting said layer inside the respective forming pocket by rolling the layer onto a bottom surface of the forming pocket.

8. A method as claimed in claim 7, wherein said orienting step comprises the sub-step of delaying said conveying seat with respect to said forming pocket prior to said transfer step.

9. A method as claimed in claim 8, wherein said orienting step comprises the sub-step of retiming said conveying seat with respect to said forming pocket as a first cigarette in the layer contacts the bottom surface of the forming pocket.

10. A method as claimed in claim 7, wherein said orienting step comprises the sub-step of advancing said conveying seat with respect to said forming pocket as a last cigarette in the layer is positioned contacting the bottom surface of the forming pocket; said conveying seat comprising compacting means for compacting the layer inside the respective forming pocket.

11. A method as claimed in claim 10, wherein said compacting means are carried on said conveying seat and movable with said conveying seat along said first path (P2).

12. A method as claimed in claim 11, wherein said forming pocket engages substantially the ends of the cigarettes in said layer, and is defined by two opposite retaining heads; the heads being set to a retaining position contacting the opposite ends of the cigarettes to retain the cigarettes in position with respect to one another, and comprising respective axial appendixes for retaining said layer in a direction crosswise to the cigarettes and substantially parallel to said bottom surface.

13. A method as claimed in claim 12, wherein each group comprises three superimposed layers of cigarettes arranged in a five-spot pattern; each layer being fed into a respective forming pocket at a respective unloading station; and said two heads being moved in steps into the retaining position so that, at each step, said appendixes retain each layer in said crosswise direction.

14. A method of forming groups of cigarettes, each group comprising at least one layer of cigarettes arranged side by side, wherein the method comprises a step of continuously feeding said layer at a given speed and by means of a transfer device comprising a carrier and a conveying seat movable on the carrier for transporting the conveying seat along a given annular first path (P2) extending through a supply station where the layer is fed into the conveying seat, and through an unloading station, the first path (P2) being substantially tangent to a second path (P1) at the unloading station, with the conveying seat being oriented from an initial position on the carrier to a second position at least at the unloading station; a step of continuously feeding a forming pocket along the second path (P1) and through said unloading station in time with said conveying seat; a transfer step whereby said layer is transferred from the conveying seat to the forming pocket at said unloading station; an orienting step whereby said conveying seat is oriented with respect to said carrier as a function of the relative position of the conveying seat and the forming pocket at least at said unloading station; and a layer compacting step whereby said conveying seat is oriented when partially enclosed in said pocket.

* * * * *